United States Patent [19]

Burrous et al.

[11] Patent Number: 4,916,863

[45] Date of Patent: Apr. 17, 1990

[54] JAMB LINER WEATHERSEAL

[75] Inventors: Allen J. Burrous, Macedon; David W. Kehrli, Fairport, both of N.Y.

[73] Assignee: Schlegel Corporation, Rochester, N.Y.

[21] Appl. No.: 360,309

[22] Filed: Jun. 2, 1989

[51] Int. Cl.[4] ..... E05D 15/16

[52] U.S. Cl. ..... 49/419; 49/454

[58] Field of Search ..... 49/419, 417, 428, 453, 49/454, 414

[56] References Cited

U.S. PATENT DOCUMENTS

| | | | |
|---|---|---|---|
| 2,267,021 | 12/1941 | Glass | 20/69 |
| 2,744,297 | 5/1956 | Baker | 20/52.2 |
| 2,796,960 | 6/1957 | Reynolds | 49/419 X |
| 2,917,788 | 12/1959 | Kunkel | 20/11 |
| 3,199,154 | 8/1965 | Johnson | 49/419 |
| 3,269,062 | 8/1966 | Mears | 49/505 |
| 3,483,658 | 12/1969 | Dallaire | 49/419 |
| 3,731,430 | 5/1973 | Dallaire et al. | 49/419 |
| 4,034,510 | 7/1977 | Huelsekopf | 49/419 |
| 4,096,665 | 6/1978 | Ellingson, Jr. | 49/414 X |
| 4,373,295 | 2/1983 | Starck | 49/435 |
| 4,606,147 | 8/1986 | DeWitt | 49/434 |
| 4,726,148 | 2/1988 | Tix | 49/453 |

*Primary Examiner*—Philip C. Kannan

*Attorney, Agent, or Firm*—Cumpston & Shaw

[57] ABSTRACT

A jamb liner has an elongated, firm, two sided substrate, at least one resilient, compressible body member attached to each side of the substrate, and an at least relatively low friction surface on at least one of the body members.

32 Claims, 2 Drawing Sheets

JAMB LINER WEATHERSEAL

This invention relates in general to window weatherseals and more particularly to a jamb liner weatherseal for sealing the spaces between the window sashes and the jambs in a side sliding or double hung window.

A jamb liner weatherseal seals the space between a window frame and the stiles of a horizontal or vertical sliding window. Among the requirements that must be satisfied by the jamb liner weatherseal are to achieve very low air leakage rates, good thermal resistance between the outside of the window and the inside, satisfactory acoustical performance, that is, low sound transmission from the outside to the inside of the window, and pleasing aesthetics. In addition, it is important that the jamb liner weatherseal provide low sliding friction, so that the window sashes may be moved easily, and preferably allow for the removal of the window sashes from the frame.

Heretofore, the great majority of modern jamb liners have used extruded plastic or aluminum elements as weatherseals. Such elements can be extruded or formed at low cost, and have provided more or less satisfactory jamb liners. However, there is a need for improved performance in the areas mentioned above, and to that end, this invention provides a jamb liner that exhibits improved performance over jamb liners heretofore known.

The most commonly employed state-of-the-art jamb liners use aluminim or a rigid plastic material, such as polyvinyl chloride to form the seal between the frame and the sliding sashes of a window. Known jamb liners do not ordinarily have any additional weatherstripping elements at the interface between the stile and the jamb liner, and consequently provide only a weak seal between the window frame and the jamb liner. Early constructions, such as those shown in Glass U.S. Pat. No. 2,267,021 and Baker et al U.S. Pat. No. 2,744,297 utilized resilient metal weathersealing elements to engage the sashes. More recently, plastic jamb liners, such as the ones shown in Kunkel U.S. Pat. No. 2,917,788 have been used, particularly in combination with plastic sashes. A construction for accommodating sashes of different thickness is illustrated in Mears, Jr. U.S. Pat. No. 3,269,062, which however still uses a metal member to form the seal to the stiles of the windows.

Presently, all plastic jamb liners are most commonly employed. U.S. Pat. Nos. 4,034,510; 4,373,295, and 4,606,147 are examples. Each of these relies upon a sliding/mating seal between the plastic jamb liner and the sliding sash. Often, because of thermal expansion and contraction of the jamb liner, both on account of seasonal temperature variations and diurnal changes, the seal between the liner and the sash may be broken at spots along the length of the liner. In addition, irregularities and imperfections in the liner itself may allow air to pass both between the liner and the sash, and between the liner and the window frame. Variations due to manufacturing tolerances contribute to these problems.

Briefly stated, and in accordance with a presently preferred embodiment of this invention, a jamb liner is provided that has an elongated, firm, two sided substrate; at least one resilient, compressible body member attached to each side of the substrate, and a relatively low friction surface on at least one of the body members.

While the novel aspects of the invention are set forth with particularity in the appended claims, the invention itself together with further objects and advantages thereof may be more fully appreciated by reference to the following detailed description of a presently preferred embodiment thereof, taken in conjunction with the accompanying drawing, in which:

Figure 1:
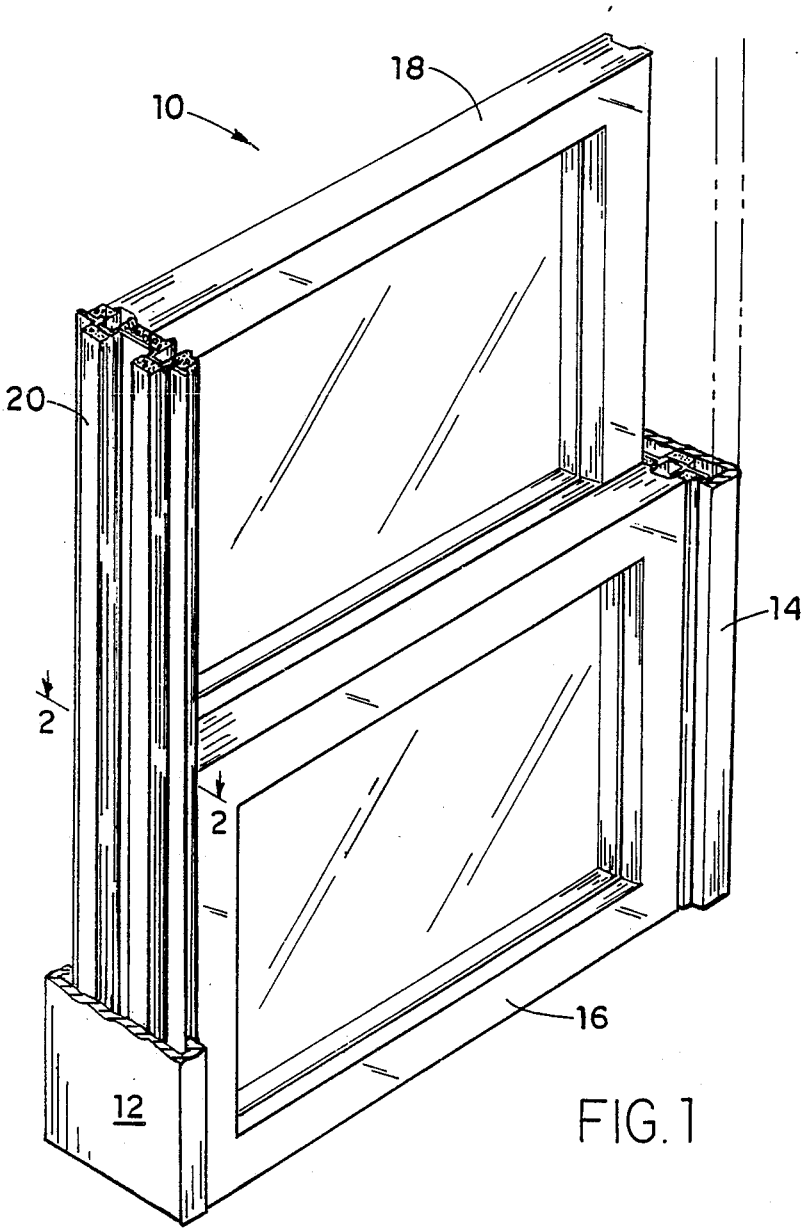
FIG. 1 is a perspective view of a double hung window employing a jamb liner in accordance with this invention.

Referring now to FIG. 1, a double hung window assembly 10 incorporating a jamb liner in accordance with this invention is shown in a fragmentary perspective view. The window assembly includes a rectangular frame of which a left frame member 12 and a right frame member 14 are illustrated. It will be understood that the window assembly 10 would also have a head and a sill, and associated weatherseal elements, which are not shown in the drawing, in order to enable the parts of this invention to be more clearly seen. A lower sash 16 and an upper sash 18 are slidably mounted between the left and right frame members 12 and 14, which frame members will subsequently be referred to as jambs.

It will be understood that although this invention is being described in connection with a double hung window assembly, it may also be used in a single hung window or in a side sliding window assembly, in which the sashes are mounted for horizontal movement and the frame members 12 and 14 are oriented 90° from their position as shown on in FIG. 1 to form the head and sill of the side sliding window assembly.

Figure 2:
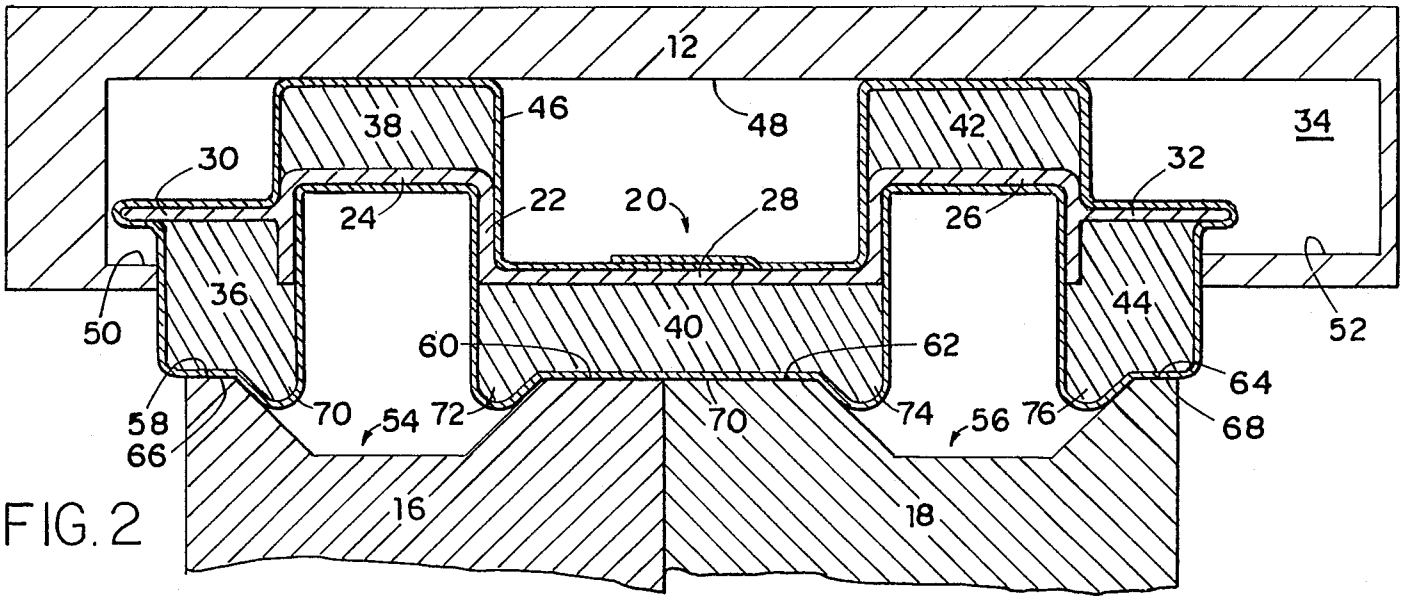
FIG. 2 is a section taken along line 2—2 of FIG. 1.

The construction of a weatherseal in accordance with this invention and its attachment to the jambs may be readily appreciated by referring now to FIG. 2, which is a section taken along line 2—2 of FIG. 1. FIG. 2 shows construction of the weatherseal, the mounting of the weatherseal in the left frame member, and the interaction between the weatherseal and the first and second sashes. The jamb liner weatherseal 20 itself is formed on an elongated firm substrate 22, which is preferably sufficiently flexible, non-conducting, and stiff, as required to support the foam weatherseal elements attached thereto. Preferably, the substrate 22 is continuously extruded from plastic material, such as vinyl or nylon or any other material that can be formed into a substrate having the above mentioned characteristics. Alternatively, the substrate 22 may be formed by a roll forming process from a long thin metal sheet.

Referring now to FIG. 2, substrate 22 has a first U-shaped section 24, and a second U-shaped section 26, joined by a straight connecting section 28. Each U-shaped section has a laterally extending retaining arm 30 and 32 respectively which retaining arms hold the weatherseal 20 within groove 34 of frame member 12.

Five resilient foam body members 36, 38, 40, 42 and 44 are attached to retaining arm 30, U-shaped section 24, connecting section 28, U-shaped section 26, and retaining arm 32 respectively, as clearly shown in FIG. 2.

Preferably, the foam body members are non-absorbing (especially with respect to water), have excellent compression resilience, excellent adhesion properties to the substrate, and low compression load deflection. Preferably, open or closed cell polyurethane foam is used to form the resilient foam body members.

The entire weatherseal 20 is preferably wrapped with a thin covering film 46. Preferably, film 46 is selected to be long wearing, puncture resistant, impervious to weather, colorfast, resistant to elongation, tear propogation resistant, chemical resistant and to provide at least some stiffness. Preferably, low friction polyethylene is used for film 46.

As will be appreciated by reference to FIG. 2, foam body members 38 and 42 engage inner surface 48 of frame member 12 and are normally compressed at least slightly when sashes 16 and 18 are not installed in the window and retaining arms 30 and 32 engage surfaces 50 and 52 respectively. This condition is not shown in FIG. 2, but may be easily visualized. When the sashes 16 and 18 are installed, foam body members 38 and 42 are further compressed, add retaining arms 30 and 32 are pushed into groove 34 to a position slightly spaced from surfaces 50 and 52. During removal of sashes 16 and 18, body members 38 and 42, as well as sash engaging body members 36, 40 and 44 may temporarily be compressed further, as the sashes are removed.

Preferably, body members 38 and 42 are rectangular in cross section and extend over substantially the entire length of the jamb liner weatherseal.

Sash engaging body members 36, 40 and 44 may be formed from the same material as members 38 and 42, or from different materials, such as polyurethane foam having a lower density, to form a more effective seal with the sashes.

Preferably sashes 16 and 18 are provided with flat bottomed V-shaped grooves 54 and 56 respectively. The V-shaped grooves are cut into substantially flat end surfaces along the edges of the sashes. The end surfaces are divided by the grooves into faces 58 and 60 on sash 16, and faces 62 and 64 on sash 18. The end surfaces 58 and 64 engage corresponding flat outer surfaces 66 and 68 of foam body members 36 and 44 respectively, while ends 60 and 62 engage flat outer surface 70 of foam body member 40.

Preferably, the body members 36, 40 and 42 are provided with generally V-shaped protrusions 70, 72, 74 and 76 at the edges of the body members, which protrusions engage the inner side surfaces of V-shaped grooves 54 and 56 respectively. The interfaces between the end surfaces of the sashes and the outer surfaces of the weatherseal assembly form a continuous seal along the edges of the sashes. These outer surfaces of the weatherseal assembly are also engaged by the horizontal weatherseals of the head, sill and check rails of the window (not shown). The V-shaped protrusions permit the sashes to be raised and lowered readily, but inhibit inward and outward movement of the sashes. However, the resilient body members 36, 40 and 44, in combination with members 38 and 42, are sufficiently compressible to allow the sashes to be removed from the window assembly when desired. Thus a window assembly is provided by this invention that satisfies all the objects set forth above.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. A jamb liner weatherseal comprising;

an elongated, firm substrate having two sides;

at least one resilient body member attached to each side of said substrate; and at least a relatively low friction surface on at least one of said body members.

2. The jamb liner weatherseal of claim 1 wherein said elongated firm substrate comprises a plastic member.

3. The jamb liner weatherseal of claim 2 wherein said plastic member comprises an extruded plastic member.

4. The jamb liner weatherseal of claim 1 wherein said resilient body member comprises a foam body member.

5. The jamb liner weatherseal of claim 4 wherein said foam body member comprises a continuously molded foam body member.

6. The jamb liner weatherseal of claim 1 wherein said substrate comprises first and second spaced apart generally U-shaped channels.

7. The jamb liner weatherseal of claim 6 wherein said substrate comprises a generally flat resilient connecting member between said first and second channels, and first and second laterally extending retaining arms attached to said channels opposite said connecting member.

8. The jamb liner weatherseal of claim 6 comprising first and second resilient body members attached to the bases of said first and second channels respectively.

9. The jamb liner weatherseal of claim 8 further comprising a third resilient body member attached to said connecting member opposite said first and second body members, and fourth and fifth resilient body members attached to the same side of said substrate as said third body member and disposed on the opposite sides of said channels.

10. The jamb liner weatherseal of claim 9 wherein said third, fourth and fifth body members comprise generally V-shaped protrusions extending away from said substrate for engaging first and second sashes.

11. The jamb liner weatherseal of claim 1 wherein said low friction surface comprises a thin film of low friction material attached to said body member.

12. The jamb liner weatherseal of claim 11 wherein said thin film of low friction material surrounds the entire weatherseal.

13. The jamb liner weatherseal of claim 11 wherein said low friction material comprises a thin film of polyethylene.

14. The jamb liner weatherseal of claim 1 wherein said resilient material comprises an extruded foam material.

15. The jamb liner weatherseal of claim 14 said foam material is urethane.

16. The jamb liner weatherseal of claim 1 wherein said elongated firm substrate comprises a metal member.

17. A window system comprising first and second spaced apart parallel frame members;

first and second elongated grooves formed in facing surfaces of said frame members;

first and second sashes slidably mounted between said frame members;

first and second weatherseal elements disposed in said grooves and extending into the space between said frame members and said sashes, said weatherseal elements comprising an elongated firm substrate having two sides;

at least one resilient body member attached to a tirst side of said substrate and engaging at least one of said sashes;

a second body member disposed on said substrate opposite said first body member and resiliently engaging said frame member; and an at least relatively low friction surface on said first body member for reducing sliding friction between said sash and said weatherseal.

18. The jamb liner weatherseal of claim 17 wherein said elongated firm substrate comprises a plastic member.

19. The jamb liner weatherseal of claim 18 wherein said plastic member comprises an extruded plastic member.

20. The jamb liner weatherseal of claim 17 wherein said resilient body member comprises a foam body member.

21. The jamb liner weatherseal of claim 20 wherein said foam body member comprises a continuously molded foam body member.

22. The jamb liner weatherseal of claim 17 wherein said substrate comprises first and second spaced apart generally U-shaped channels.

23. The jamb liner weatherseal of claim 22 wherein said substrate comprises a generally flat resilient connecting member between said first and second channels, and first and second laterally extending retaining arms attached to said channels opposite said connecting member.

24. The jamb liner weatherseal of claim 23 comprising first and second resilient body members attached to the bases of said first and second channels respectively.

25. The jamb liner weatherseal of claim 24 further comprising a third resilient body member attached to said connecting member opposite said first and second body members, and fourth and fifth resilient body members attached to the same side of said substrate as said third body member and disposed on the opposite sides of said channels.

26. The jamb liner weatherseal of claim 25 wherein said third, fourth and fifth body members comprise generally V-shaped protrusions extending away from said substrate for engaging first and second sashes.

27. The jamb liner weatherseal of claim 17 wherein said low friction surface comprises a thin film of low friction material attached to said body member.

28. The jamb liner weatherseal of claim 27 wherein said thin film of low friction material surrounds the entire weatherseal.

29. The jamb liner weatherseal of claim 27 wherein said low friction material comprises a thin film of polyethylene.

30. The jamb liner weatherseal of claim 17 wherein said resilient material comprises an extruded foam material.

31. The jamb liner weatherseal of claim 30 wherein said foam material is urethane.

32. The jamb liner weatherseal of claim 17 wherein said elongated firm substrate comprises a metal member.

* * * * *